US005381776A

United States Patent [19]

Matsubara et al.

[11] Patent Number: 5,381,776

[45] Date of Patent: Jan. 17, 1995

[54] AIR-FUEL RATIO CONTROL SYSTEM FOR ENGINE

[75] Inventors: Toshio Matsubara; Haruyuki Kato; Yuji Ota; Hideki Tominaga, all of Higashihiroshima, Japan

[73] Assignee: Mazda Motor Corporation, Hiroshima, Japan

[21] Appl. No.: 102,781

[22] Filed: Aug. 6, 1993

[30] Foreign Application Priority Data

Aug. 6, 1992 [JP] Japan ..... 4-210469
Jul. 12, 1993 [JP] Japan ..... 5-171575

[51] Int. Cl.[6] ..... F02M 51/00; F02M 7/00

[52] U.S. Cl. ..... 123/681; 123/680; 123/682

[58] Field of Search ..... 123/681, 682, 344, 588, 123/680; 364/431.03, 431.01

[56] References Cited

U.S. PATENT DOCUMENTS

| | | | |
|---|---|---|---|
| 4,617,891 | 10/1986 | Kishida et al. | 123/344 |
| 4,660,533 | 4/1987 | Watabe et al. | 123/588 |
| 4,759,329 | 7/1988 | Nobuo et al. | 123/681 |
| 4,763,264 | 8/1988 | Okuno et al. | 364/431.01 |
| 4,843,558 | 6/1989 | Bergmann et al. | 364/431.03 |
| 4,886,026 | 12/1989 | Cook | 123/681 |
| 4,892,078 | 1/1990 | Fukutomi et al. | 123/681 |
| 5,220,904 | 6/1993 | Miyashita et al. | 123/680 |

FOREIGN PATENT DOCUMENTS

| | | | |
|---|---|---|---|
| 60-33316 | 10/1985 | Japan | 123/681 |
| 2-130240 | 5/1990 | Japan | 123/681 |

*Primary Examiner*—Raymond A. Nelli
*Attorney, Agent, or Firm*—Keck, Mahin & Cate

[57] ABSTRACT

An air-fuel ratio control system for an engine, to which evaporated fuel in a canister is supplied, is used for feedback controlling an air-fuel ratio based on a feedback control value calculated according to the quantity of evaporated fuel supplied to the engine. A calculation is made, in a first range of engine operating conditions, of a difference of a first control value between the first control value determined during supplying of the evaporated fuel to the engine and the first control value determined during not supplying of the evaporated fuel to the engine in the first range. A second control value for a second range of engine operating conditions is established different from the first range based on a feedback control value for controlling an air-fuel ratio of fuel in the first range, a ratio of the quantity of intake air into the engine between the first and second ranges, and a ratio of the supplying quantity of the evaporated fuel into the engine between the first and second ranges. An air-fuel ratio is feedback controlled with the second control value in the second range.

6 Claims, 11 Drawing Sheets

START
S201
READ SIGNALS: Ne, Ce, Vo, CirIn, Cfb
S202
START-UP
NO
YES
S203
F = 0
S204
F = 0
NO
YES
S205
ON-FEEDBACK CONTROL
NO
YES
S206
ON-PURGING
NO
YES
S207
Vo(i-1) = 0
NO
YES
S208
Vo(i) = 1
NO
YES
S209
Cfb(i)
S210
Vo(i+1) = 0
NO
YES
S211
Cfb(i+1)
RETURN
A
B

AIR-FUEL RATIO CONTROL SYSTEM FOR ENGINE

BACKGROUND OF THE INVENTION

1. Field of the Invention

This invention relates to an air-fuel ratio control system for an internal combustion engine, and, more particularly, to air-fuel ratio control system for an engine which is supplied with fuel evaporated in a fuel tank and collected.

2. Description of Related Art

Air-fuel ratio control systems of this kind have a canister positioned between an air intake passage and a fuel tank and a purge valve positioned between the canister and the air intake passage. This purge valve is opened according to openings of an engine throttle valve to supply evaporated fuel into the engine so as to burn the evaporated fuel keeping an air-fuel ratio less changed. Such an air-fuel ratio control system is known from, for instance, Japanese Unexamined Utility Model Publication No. 60-33316.

The air-fuel ratio control system described in the above-mentioned publication has the advantage that evaporated fuel is effectively used and, since supply of evaporated fuel does not cause a rapid change in air-fuel ratio of a fuel mixture, the evaporated fuel is burned without bringing the engine into undesirable operating conditions. Because of supplying evaporated fuel without rapidly changing the air-fuel ratio, this air-fuel ratio control system is referred to a linear purging system.

However, because configurations of the conventional linear purging systems of this type premise that purging is allowed only in a range in which air-fuel ratio feedback control is performed, in other words, that when a large quantity of evaporation, which disables a proper feedback control of air-fuel ratio, is caused, a certain quantity of the evaporated fuel is released off into air, the evaporated fuel is not always effectively used.

Accordingly, in addition to the elimination of draining of evaporated fuel which is required from a viewpoint of strict environmental regulations, it is required to consume almost all of evaporated fuel in the whole range of engine operating conditions. On the other hand, in order to trap the entire quantity of evaporated fuel from a fuel tank without releasing it partially, a large capacity of canister is essential.

However, as previously described above, because the linear type of purging systems premise air-fuel ratio feedback control, they are hard to expand the purging quantity of fuel not accompanying the deterioration of running performance of vehicles. For instance, a purging system, described in, for instance, Japanese Unexamined Patent Publication No. 2-130240, which lets a control value learned during idling under on-purging is reflected in non-idling according to the quantity of intake air. However, the quantity of fuel re-evaporated from a canister is not simply determined based on the quantity of intake air only, and consequently, it does not function with a high accuracy during non-idling.

SUMMARY OF THE INVENTION

It is therefore an object of the present invention to provide an air-fuel ratio control system for an engine operative in at least two different ranges of operations, which eliminates the necessity of correction control value for air-fuel ratio feedback control related to supplying of evaporated fuel.

The foregoing object of the present invention is accomplished by providing an air-fuel ratio feedback control system for feedback controlling an air-fuel ratio based on a feedback control value calculated according to the supplying quantity of evaporated fuel to an engine. The control system calculates in a first range of engine operating conditions, such as engine idling conditions, a difference of a first control value between during supplying of evaporated fuel to the engine and during not supplying of evaporated fuel to the engine in the first range. Further, based on a feedback control value for controlling an air-fuel ratio in the first range, a ratio of the quantity of intake air into the engine between the first and second ranges, and a ratio of the supplying quantity of evaporated fuel between the first and second range, a second control value is established for a second range of engine operating conditions different from the first range, i.e. non-idling engine operating conditions, with which feedback controlling of an air-fuel ratio is executed in the second range. Further, the control system correctively provides a succeeding second control value in the second range based on the control value in the first range and the second control value in the second range.

Specifically, the second control value may be established based further on a ratio of engine rotational speeds between the first and second ranges and/or on what is called a deairing value defined according to the purging quantity of air passing through said canister and the trapped quantity of fuel in a canister.

According to the air-fuel control system according to the present invention, because a feedback correction coefficient Cfb or a learning correction coefficient ClrIP learned during idling must certainly reflect the property of a canister, using the correction coefficient Cfb or ClrIP enables to quantitatively establish a learning correction coefficient ClrInP for non-idling and on-purging with a high accuracy. Accordingly, air-fuel feedback control with the learning correction coefficient ClrInP thus established accurately reflects the re-evaporated quantity of fuel and consequently, is performed with a high precision.

Furthermore, conducting a deairing correction lets a learning correction coefficient ClrInP under non-idling or ClrIP under on-idling reflect the trapped quantity of evaporated fuel in a canister. Accordingly, a large quantity of air is purged without causing a large change in air-fuel ratio. In addition, a deairing coefficient is varied according to the difference of learning correction coefficient $\delta$Clr (=ClrIP−ClrIPn) during idling between on-purging and off-purging. This eliminates differences of property between canisters, so as to provide the execution of accurate air-fuel ratio feedback control.

BRIEF DESCRIPTION OF THE DRAWINGS

The above and other objects and features of the present invention will be clearly understood from the following detailed description with respect to preferred embodiments thereof when considered in conjunction with the accompanying drawings, in which.

DETAILED DESCRIPTION OF THE PREFERRED EMBODIMENT

Figure 1:
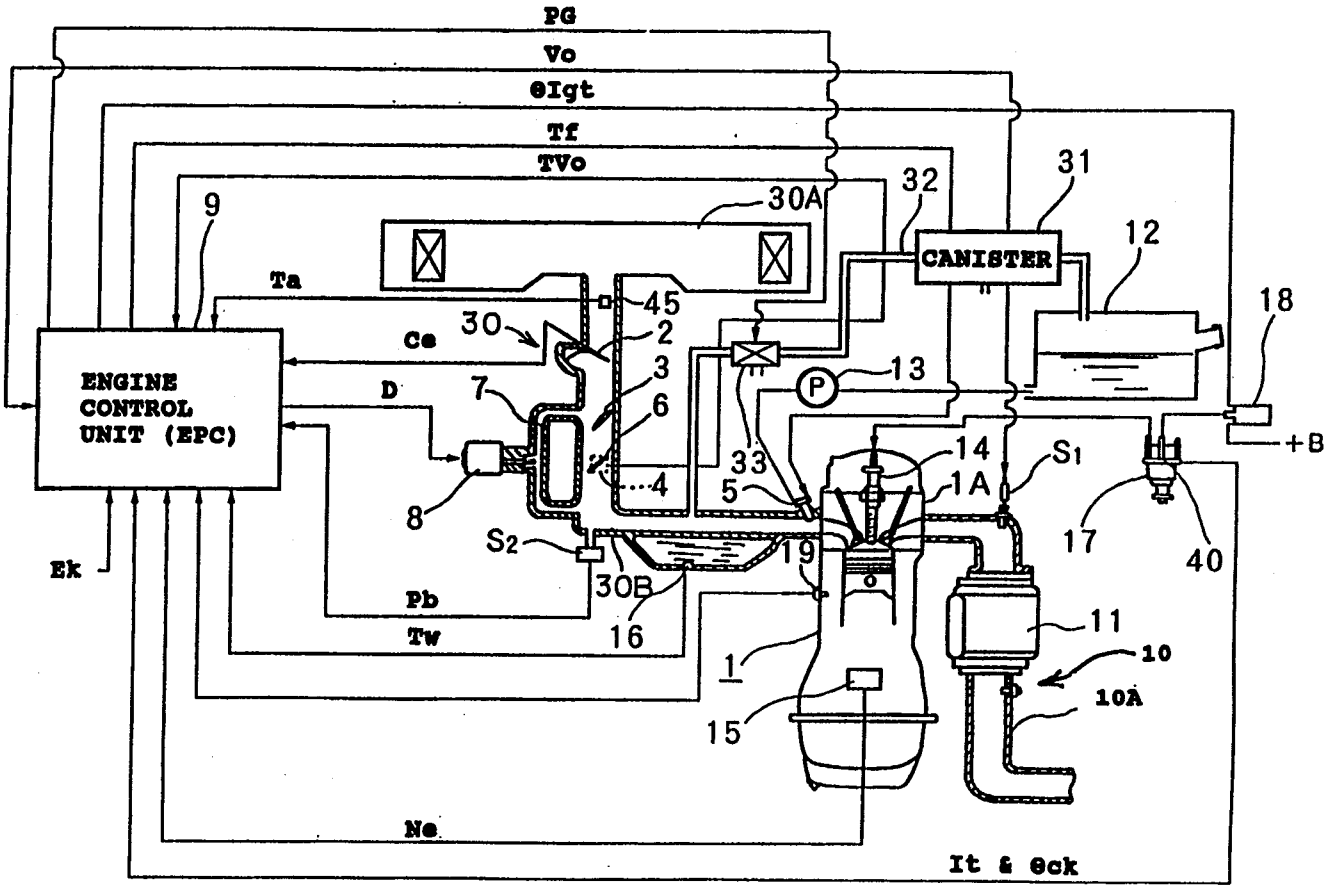
FIG. 1 is a schematic illustration of an air-fuel ratio control system in accordance with a preferred embodiment of the present invention.

Referring to the drawings in detail, and in particular, to FIG. 1, an air-fuel ratio control system in accordance with a preferred embodiment of the present invention, which cooperates with, for instance, an in-line, four cylinder internal combustion engine 1, is shown. Air is introduced into engine 1 through an intake system 30 with an air cleaner 30A. This intake system includes an intake passage 30B provided with an air-flow meter 2 and formed with a throttle chamber 3. On the other hand, fuel is supplied into engine 1 from a fuel tank 12 by means of a fuel pump 13 and injected through a fuel injector 5. The quantity of intake air is regulated by a throttle valve 6 disposed within throttle chamber 3 according to depressed strokes of an accelerator pedal (not shown) Throttle valve 6 is closed to a minimum opening during deceleration and idling. When throttle valve 6 is closed, an idle switch (ID switch) is excited to provide a signal representative of idling which is monitored by an engine control unit (ECU) 9 which will be described in detail later.

Throttle chamber 3 is provided with a bypass passage 7 for allowing air to flow bypassing throttle valve 6 within which an electric current controlled electromagnetic (ISC) valve 8 is located for controlling the rotational speed of engine during idling and during supplying dash-pot air. Accordingly, in a range of engine idling conditions and under a state of supplying of dash-pot air, intake air passed air-flow meter 2 is introduced into engine 1 through bypass passage 7 and the quantity of the intake air regulated by electromagnetic (ISC) valve 8. This electromagnetic (ISC) valve 8 is operated to open and close at a duty rate D of a control signal provided by the engine control unit (ECU) 9.

An exhaust system 10 is provided with a three-way catalytic converter 11 in an exhaust pipe 10A, an oxygen sensor ($O_2$ sensor) S1, positioned upstream from the three-way catalytic converter 11, for monitoring the concentration of oxygen ($O_2$) in exhaust gases. The engine itself has what is called a knock sensor for detecting engine knocking.

The engine control unit (ECU) 9, which has a function of air-fuel ratio control for an electronic fuel injection system, determines the elementary injecting quantity of fuel Tp based on the quantity of intake air Q detected by the air-flow meter 2 and the rotational speed of engine Ne detected by an engine speed sensor 15. Further, it detects an air-fuel ratio (A/F) based on the concentration of oxygen Vo monitored by the oxygen sensor S1 so as to cause the electronic fuel injection system to feedback control the elementary injecting quantity of fuel Tp on the basis of the deviation between the actual air-fuel ratio and a target air-fuel ratio, thereby trying to maintain a specific air-fuel ratio of fuel mixture, which is generally set near a theoretical air-fuel ratio of 14.7. The air-fuel ratio control system generally provides the actual injecting quantity of fuel through steps shown in FIG. 2, which will be described in detail later.

An ignition plug 14, positioned on the top of a cylinder head of engine 1, is impressed with a specific spark voltage through a distributor 17 and an ignitor 18. A timing of voltage impression, i.e. an ignition timing, is controlled by an ignition timing signal ΘIgt provided to the ignitor 18 from the engine control unit (ECU) 9. A boost pressure sensor S2 is provided within the intake passage 30B to detect a boost pressure Pb corresponding to engine load.

Engine control unit (ECU) 9 comprises a central processing unit (CPU) made of a micro-computer and various circuits, such as a circuit for calculating the quantity of intake air Q, a circuit for calculating the injecting quantity of fuel and the time of ignition, a circuit for judging the octane number of fuel, memories, such as a read only memory (ROM) and a random access memory (RAM), and an interface (I/O) circuit. Through the interface circuit, the engine control unit (ECU) 9 receives various signals, such as an engine start signal from a starter switch (not shown), an engine speed Ne from the speed sensor 15, a coolant temperature signal Tw from a thermistor 16, a throttle opening signal TVo from a throttle opening sensor 4, an intake air signal Q from the air-flow sensor 2, in addition to signals Vo and Pb described above. Based on these signals, the engine control unit (ECU) 9 provides a corrective control of the injecting quantity of fuel according to engine operating ranges and a learning control of the injecting quantity of fuel.

The engine 1 is accompanied by a canister 31, positioned between the intake passage 30B downstream from the throttle valve 6 and the fuel tank 12, in which evaporated fuel in the fuel tank is collected and captured. This canister 31 contains therein charcoal or carbon in its body by which evaporated fuel from the fuel tank 12 is adsorbed. Captured fuel in the canister 31 is purged into the intake passage 30B through a fuel delivery passage 32 when the purge valve 33 is opened. The purge valve is controlled to open and close with a purge control signal PG from the engine control unit (ECU) 9.

Fuel Injection Control

Figure 2:
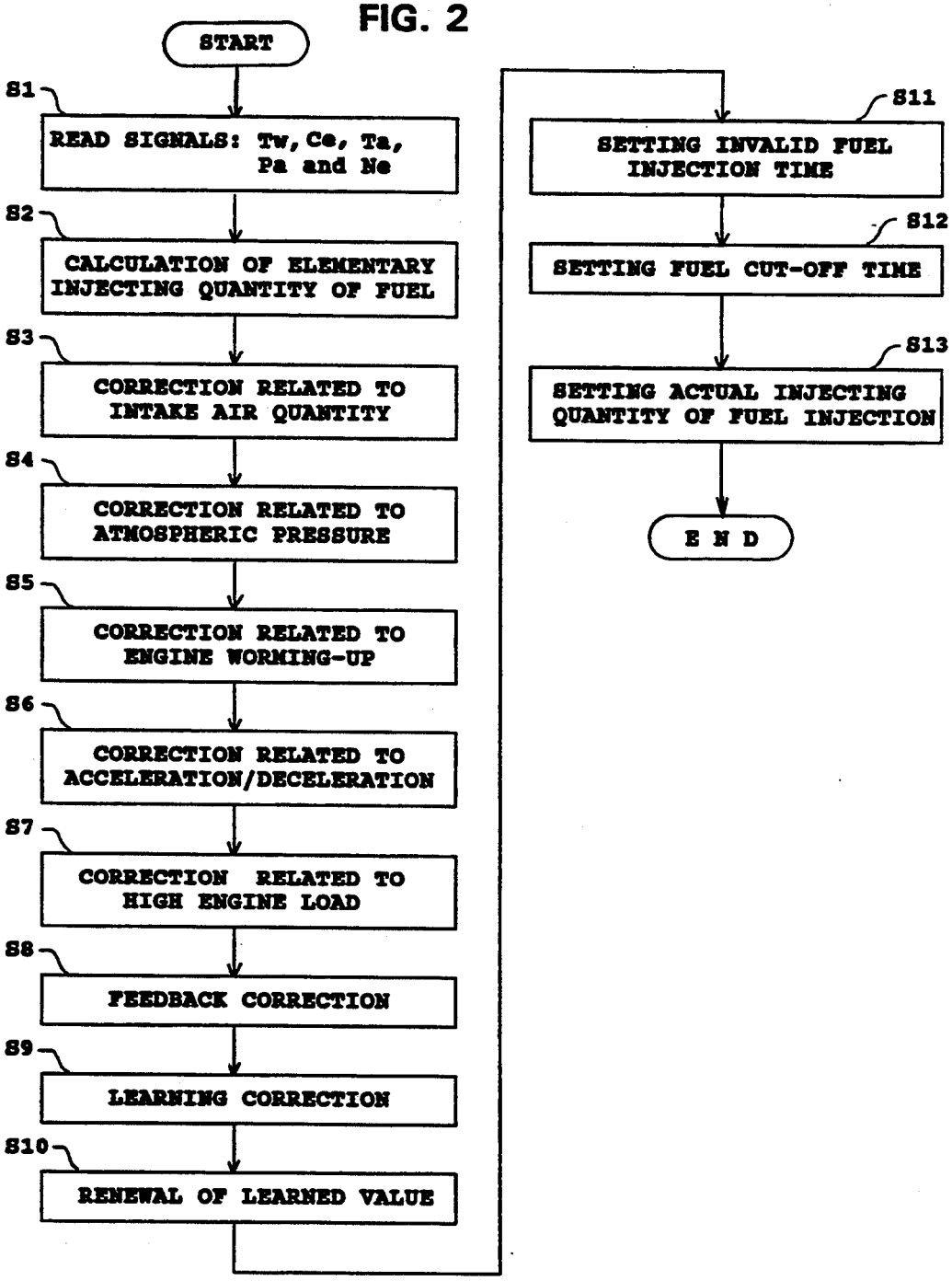
FIG. 2 is a flow chart of a fuel supply control main routine for a micro-computer of an engine control unit.

Referring to FIG. 2, which is a flow chart illustrating the fuel injection control routine, the routine commences and control passes directly to step S1 where various signals Tw, Q, Ta, Pa and Ne which respectively indicate the temperature of engine coolant, the quantity of intake air, the temperature of intake air, the pressure of atmosphere, the rotational speed of engine. Then, on the basis of the quantity of intake air (Ce) and the rotational speed of engine (Ne), an elementary injecting quantity of fuel (Tp) is calculated at step S2.

Subsequently, various corrections of the injecting quantity of fuel are conducted correspondingly engine operation ranges through steps S3–S7. That is, corrections conducted through these steps are: 1) an intake air temperature related correction with the use of a correction coefficient Ca at step S3; 2) an atmospheric pressure related correction with the use of a correction coefficient Cat at step S4; 3) a warming-up related correction with the use of a correction coefficient Cw at step S5; 4) an acceleration/deceleration related correction with the use of a correction coefficient Cac at step S6; and 5) a high engine load related correction with the use of a correction coefficient Cel at step S7. Thereafter, an air-fuel ratio feedback control is conducted with the use of a feedback correction coefficient Cfb based on the concentration of oxygen (Vo) monitored by the oxygen sensor S1 at step S8, and an air-fuel ratio learning control is conducted with the use of a learning correction coefficient Clr. That is, an elementary injecting quantity of fuel (Tp) is calculated as follows:

$$Tp = Tp \times (1 + Ca + Cp + Cw + Cac + Cel + Cfb + Clr) \quad \text{(I)}$$

This feedback air-fuel ratio correction coefficient Cfb for air-fuel ratio feedback control is calculated by a well known proportional integral/differential (PID) control. Briefly describing, when the air-fuel ratio feedback control is conducted in an integral control (I control) mode, if the concentration of oxygen (Vo) is at a level for rich air-fuel ratios, the feedback air-fuel ratio correction coefficient Cfb is expressed as follows:

$$Cfb = Cfb - \delta I \quad \text{(II)}$$

On the other hand, if the concentration of oxygen (Vo) is at a level for lean air-fuel ratios, the feedback correction coefficient Cfb is expressed as follows:

$$Cfb = Cfb + \delta I \quad \text{(III)}$$

Thereafter, air-fuel ratio correction coefficients ClrIP and ClrIPn, based on which the learning correction coefficient Clr is obtained, are learned and renewed at step S10. In this specification, symbols "I," "In," "P" and "Pn" indicates on-idling, non-idling, on-purging and off-purging, respectively, for the sake of convenience. That is, a learning correction coefficient ClrIP is one learned during on-idling and on-purging; a learning correction coefficient ClrIPn is one learned during on-idling and off-purging.

Then, control proceeds and after setting an invalid fuel injection time at step S11 and designated or setting cylinders which is shut off from fuel injection at step S12, the actual injecting quantity of fuel Tf is established. The fuel injector 5 is driven with a drive pulse having a duty rate D corresponding to the actual injecting quantity of fuel Tf to inject fuel into the engine 1.

Learning Control Related Supply of Evaporated Fuel

For the sake of description convenience, the term "re-evaporated quantity of fuel (Fre)" as used in this specification shall mean and refer to the quantity of fuel trapped once in the canister 31 and forced into the intake passage 30B after re-evaporation. In this control, a correction coefficient for evaporated fuel control on-idling is utilized to estimate a learning correction in evaporated fuel control during non-idling. This is because, during idling, the engine is stable in operation and consequently, the supply of evaporated fuel is stably made.

The estimation of the re-evaporated quantity of fuel inspired into an engine is performed as described below.

First of all, when the engine is idling, the quantity of intake air (or air charging efficiency) Ce and a change in air-fuel ratio (practically a feedback correction coefficient Cfb for air-fuel feedback control), accompanying an induction of a specific purging quantity of air, are detected. The term a "purging quantity of air (Cpa)" as used herein shall mean and refer to the quantity of air introduced into the intake passage 30B from the canister 31. Further, the change in air-fuel ratio is hereafter referred to the on-idling feedback correction coefficient Cfb for the sake of convenience. Principally, the re-evaporated quantity of fuel during non-idling is proportional to that during idling, and the evaporated quantity of fuel during non-idling is inversely proportional to the rotational speed of engine Ne and the inspired quantity of intake air Ce. Noticing these facts, a decreasing correction coefficient ClrInP (InP indicates non-idling and on-purging) for air-fuel ratio learning control following the supply of evaporated fuel is expressed as follows:

$$ClrInP = (FreIn/[FreI]) \times ([NeI]/NeIn) \times ([CeI]/CeIn) \times [CfbI] \quad \text{(IV)}$$

wherein a value in brackets indicates a learning value or a mean value.

An non-idling learning correction coefficient ClrIn is presumed to be proportional to a learning value (practically an integrated value) of an on-idling feedback correction coefficient Cfb. Although, essentially, the non-idling learning correction coefficient ClrIn must be presumed to be proportional to the trapped quantity of fuel in the canister 31, in the equation (IV), a change in air-fuel ratio, i.e. the on-idling feedback correction coefficient Cfb, learned during idling, is substituted for the trapped quantity of fuel.

Neither on-idling nor non-idling re-evaporated quantity of fuel is directly estimated. However, the purging quantity of air, i.e. the quantity of air flowing through the canister 31, may be substituted for the quantity of fuel drifting away from the canister 31. Accordingly, the equation (IV) may be rewritten as follows:

$$ClrInP = (CpaIn/[CpaI]) \times ([NeI]/NeIn) \times ([CeI]/CeIn) \times [CfbI] \quad \text{(V)}$$

However, practically, the re-evaporated quantity of fuel Fre is not directly proportional to the purging quantity of air Cpa and actually varies depending upon a trapping condition of canister 31.

Figure 3:
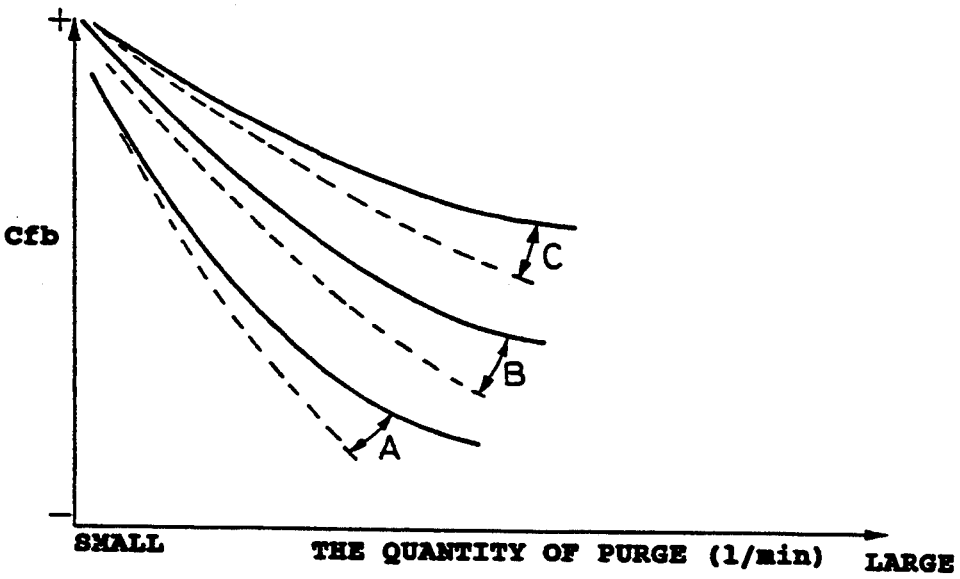
FIG. 3 is a diagram showing the relation between an air-fuel ratio feedback control coefficient Cfb and the purging quantity of air.

Referring to FIG. 3, the relation between the feedback correction coefficient Cfb and the purging quantity of air Cpa is shown. Dashed curves show relations between them when they are directly proportional to each other, and solids curves show experimental relations between them. Further, curve "A" is the relation when the canister 31 has trapped evaporated fuel fully to its capacity; curve "B" is the relation when the canister 31 decreases the quantity of fuel trapped therein; and curve "C" is the relation when the canister 31 is almost empty.

Figure 4:
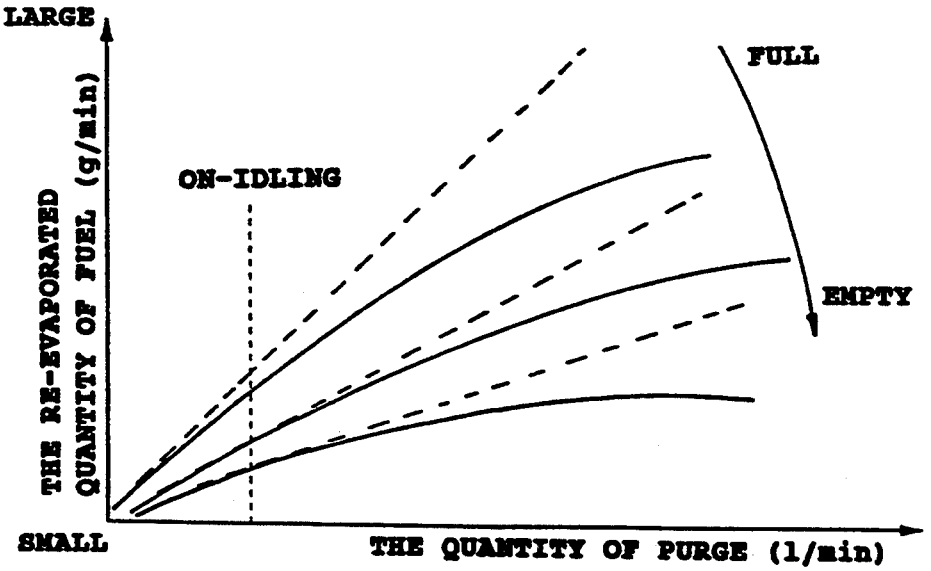
FIG. 4 is a diagram showing the relation between the purging quantity of air and the re-evaporated quantity of fuel.

Referring to FIG. 4, the relation of the re-evaporated quantity of fuel with respect to the purging quantity of air.

As apparent from FIGS. 3 and 4, since, during non-idling, the re-evaporated quantity is hardly proportional to the purging quantity of air, an appropriate correction is required. For this correction, what is called a deairing correction coefficient Cda is used. Then, the equation (V) may be modified as follows:

$$ClrInP=(CpaIn/[CpaI])\times Cda\times([NeI]/NeIn)\times([CeI]/CeIn)\times[CfbI] \quad \text{(VI)}$$

Figure 5:
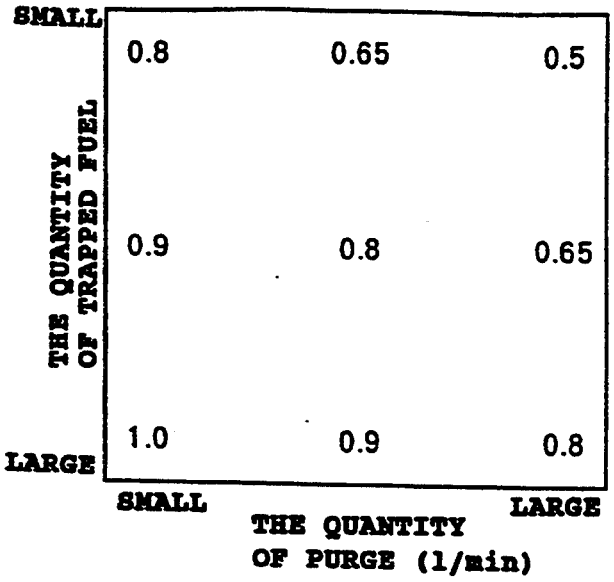
FIG. 5 is an illustration showing a map of deairing correction coefficients.

As shown in FIG. 5, this deairing correction coefficient Cda is defined in the form of a map with respect to the purging quantity of air Cpa and the trapping quantity of fuel (for which a learning correction coefficient ClrIP during idling and purging is substituted). The on-idling purging quantity of air CpaI, the on-idling rotational speed of engine NeI, the on-idling quantity of intake air CeI, and the on-idling feedback correction coefficient CfbI are calculated during idling and memorized. During non-idling, the deairing correction coefficient Cda is retrieved with respect to the purging quantity of air at the time of retrieval. Because for the on-idling feedback correction coefficient CfbI, a learning correction coefficient ClrIP during idling and purging is substituted, the non-idling feedback correction coefficient CfbIn while evaporated fuel is supplied into the intake passage 30B during non-idling is expressed as follows:

$$ClrInP=(CpaIn/[CpaI])\times Cda\times([NeI]/NeIn)\times([CeI]/CeIn)\times ClrIP \quad \text{(VII)}$$

Figure 6:
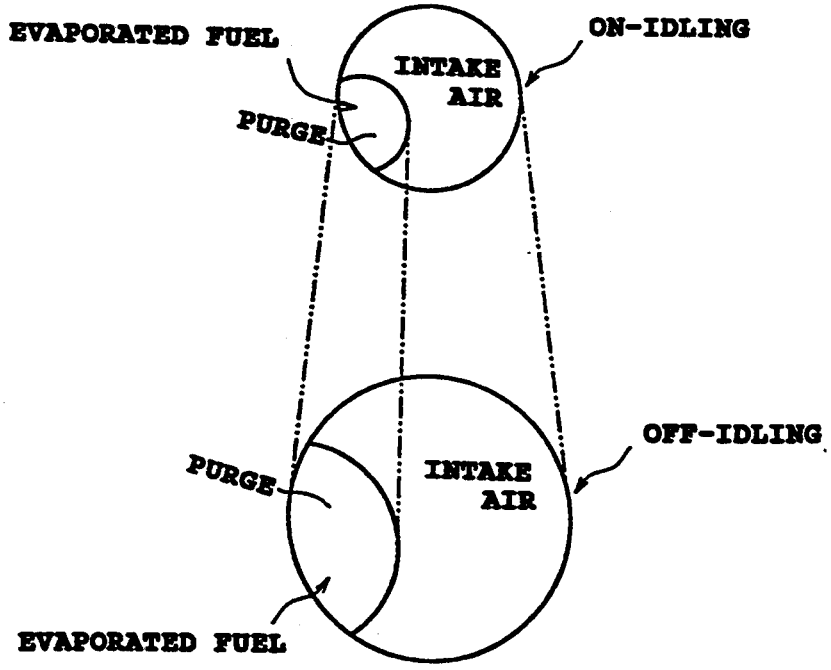
FIG. 6 is an illustration showing the concept of operation of the air-fuel ratio control system.

Referring to FIG. 6, which illustrates the above technique, the difference of air-fuel correction coefficient in the range of idling operation between on-purging and off-purging, which is learned as the re-evaporated quantity of fuel together with engine operating conditions, such as the rotational speed of engine, the quantity of intake air and the purging quantity of air, is reflected in other range of engine operation, i.e. non-idling operation. Accordingly, a correction is not always necessary for the respective ranges of engine operations. Furthermore, a magnification in purging quantity is realized without being accompanied by a large change in air-fuel ratio.

In this embodiment, the learning correction coefficient Clr is not established separately for on-idling and on-purging conditions and non-idling and on-purging conditions. This is because, since, during idling, the product of members of the equation (VII) of (CpaIn/[CpaI])×Cda×([NeI]/NeIn)×([CeI]/CeIn) is one (1), the equation (VII) can be practically applied to on-idling. That is, the equation (VII) representing the learning correction coefficient Clr, which is a member of the equation (I), is expressed as follows:

$$\begin{aligned} Clr &= ClrIP \text{ or } ClrInP \\ &= (CpaIn/[CpaI]) \times Cda \times (NeI/NeIn) \times (CeI/CeIn) \times ClrIP(i) \end{aligned} \quad \text{(VIII)}$$

where ClrIP(i) is the on-idling and on-purging latest correction coefficient learned latest and renewed.

in this embodiment, the property of air-fuel ratio feedback is learned even during off-purging. Because, in the operation range in which purging is not conducted, the system provides stable air-fuel feedback during idling, the result of learning reflects accurately the property of air-fuel ratio feedback. For this reason, if purging is not effected during idling, the property of air-fuel feedback is learned as a learning correction coefficient clrIPn for on-idling and off-purging, which is substituted for a learning correction coefficient ClrIPn during non-idling and off-purging. That is, the learning correction coefficient Clr, which is a member of the equation (I), is expressed as follows:

$$Clr=ClrInPn=CpaIPn\times(NeI/NeIn)\times(QI/QIn) \quad \text{(IX)}$$

Figure 7:
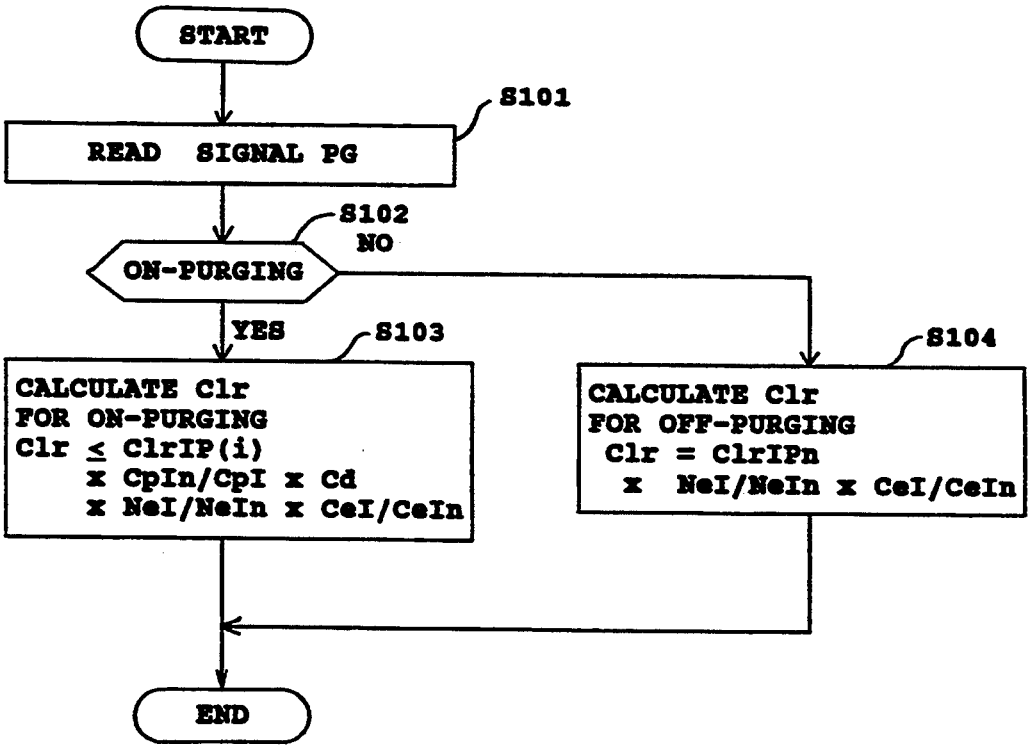
FIG. 7 is a flow chart of an air-fuel ratio learning control subroutine for the micro-computer of the engine control unit.

Referring to FIG. 7, which is a flow chart illustrating the learning correction subroutine carried out at step S9 shown in FIG. 2, the routine commences and control proceeds directly to step S101 where a signal PG representative of the state, open or closed, of purge valve 33. Subsequently, a decision is made at step S102 as to whether the purge valve 33 has been opened so as to purge trapped fuel in the canister 31 toward the engine 1. If the answer is "YES," then, the equation (VIII) is calculated to obtain a learning correction coefficient Clr during purging at step S103. In this instance, since the equation (VIII) is applicable to on-idling and non-idling, the learning correction coefficient Clr calculated at step S103 is certainly regarded as one learned based on a learning correction coefficient ClrIP during idling and purging taking the purging quantity of air during non-idling into consideration.

On the other hand, id the answer to the decision is "NO," this indicates off-purging, then, the equation (IX) is calculated to obtain a learning correction coefficient Clr during non-idling and off-purging based on a learning correction coefficient Clr learned during idling and off-purging at step S103.

In this manner, an on-idling learning correction coefficient Clr for the supply control of evaporated fuel is determined according to purging condition and off-purging condition in the specific range of engine operation, i.e. the range of idling operation. Based on-idling learning correction coefficient Clr for the supply control of evaporated fuel thus determined, a fuel injection correction coefficient during non-idling is determined as will be detailed later.

Figures 8, 8A, 8B, 8C, 8D:
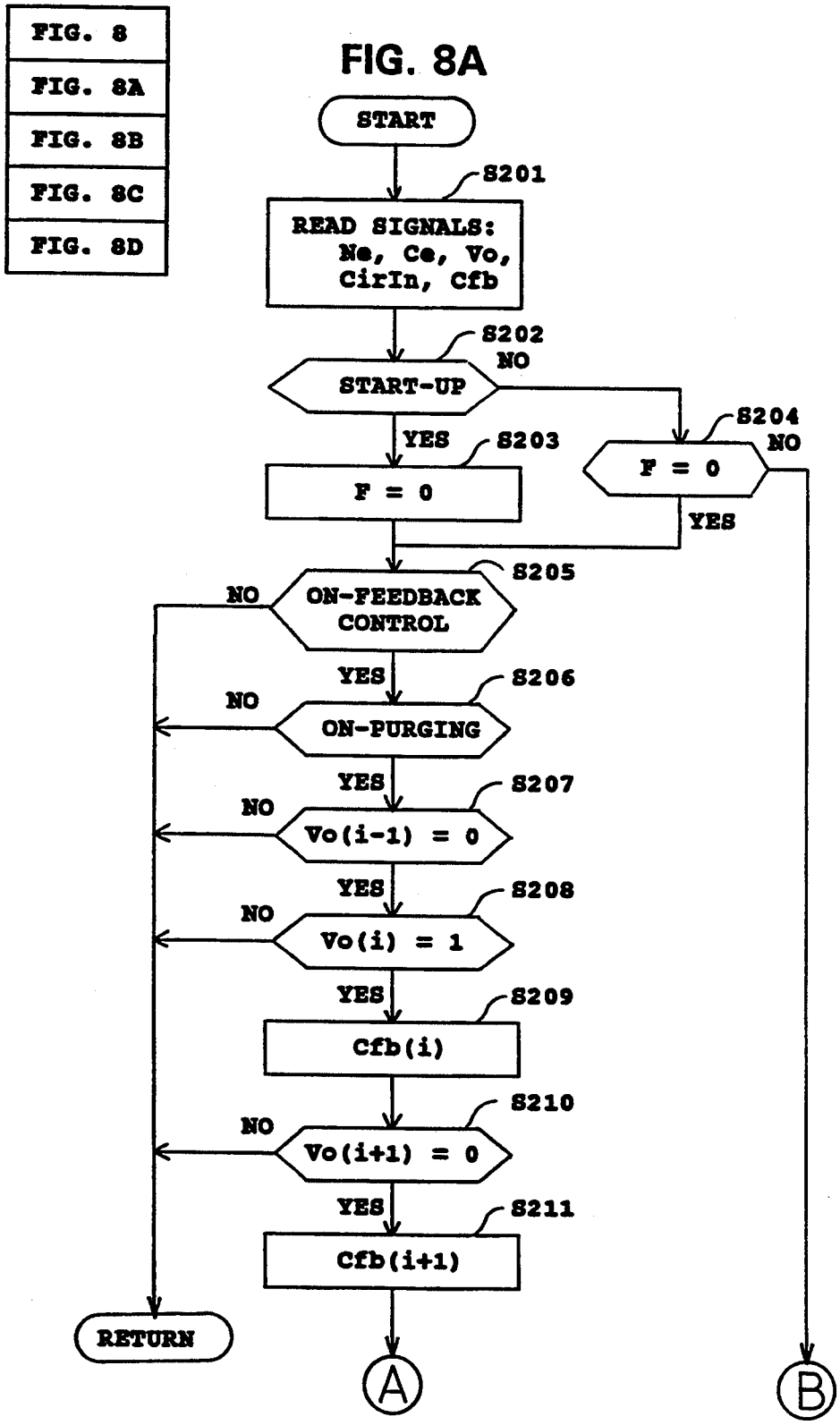
FIGS. 8 and 8A to 8D are a flow chart of a learning correction coefficient renewal subroutine for the micro-computer of the engine control unit.
Figure 8B:
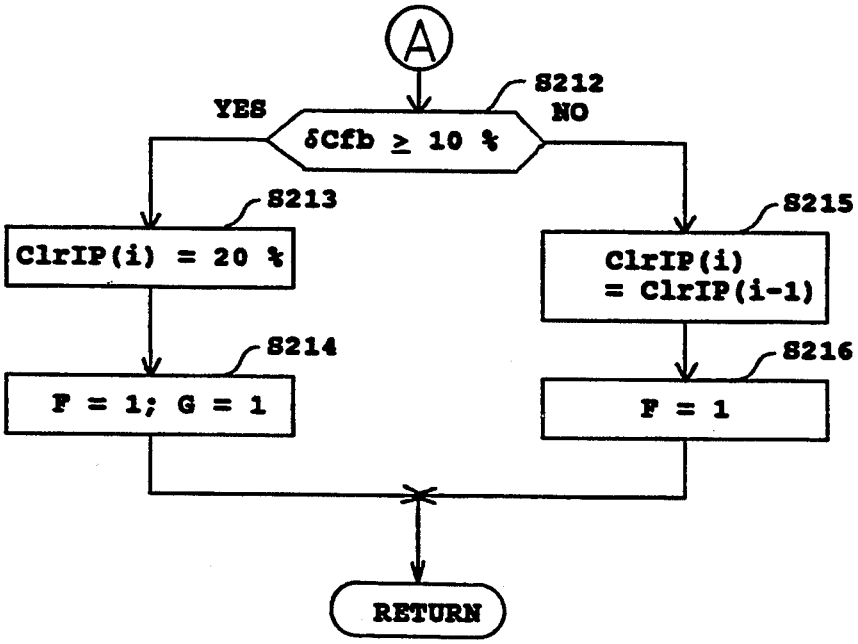
Figure 8C:
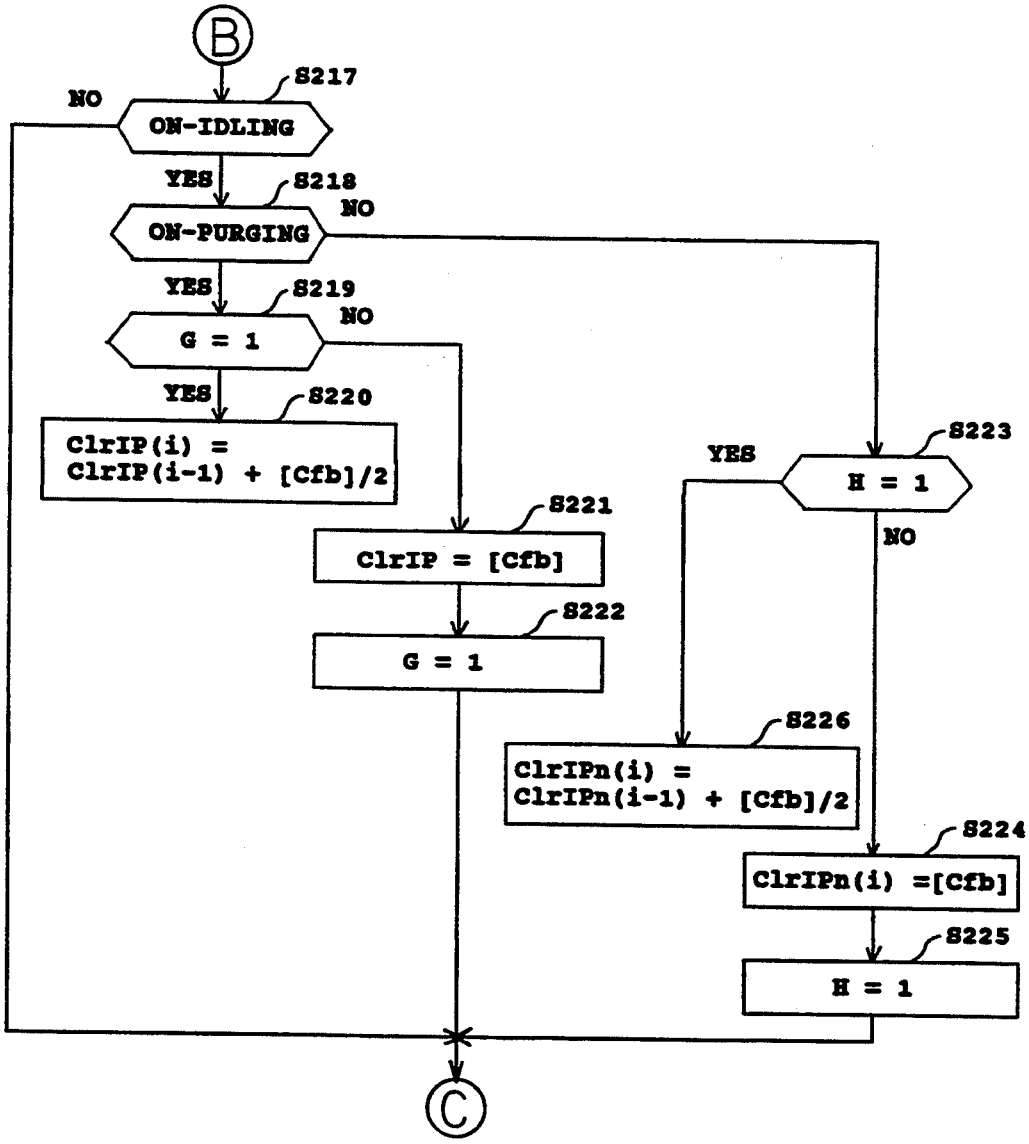
Figure 8D:
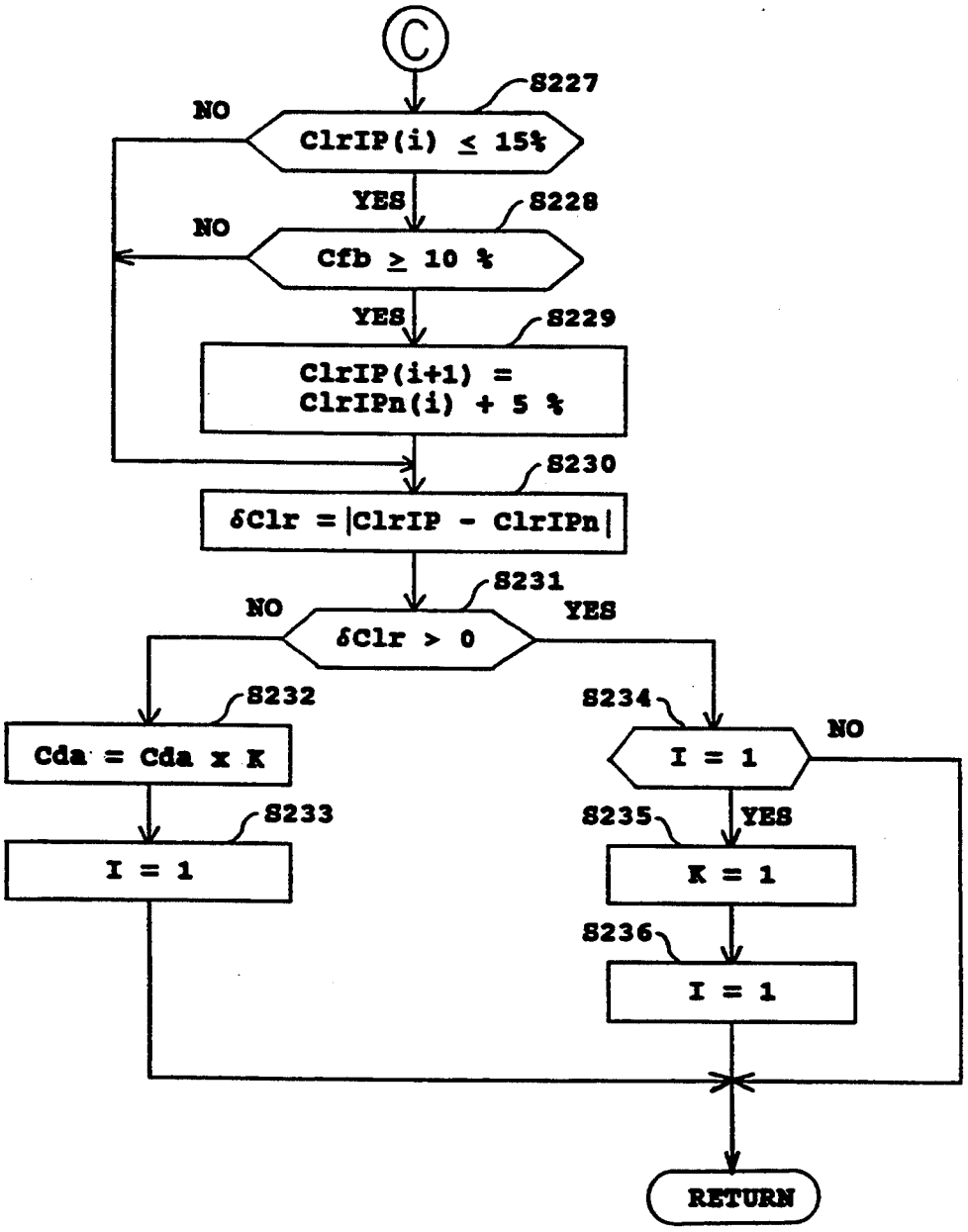

Referring to FIG. 8, which is a flow chart illustrating the learning control sequential subroutine of learning correction coefficients ClrIP and ClrIPn, the sequence commences and control passes directly to step S201 where various signals Ne, Ce, Vo, Clr and Cfb, representative of the rotational speed of engine, the quantity of intake air, the concentration of oxygen, a correction coefficient of the purging quantity of air and feedback correction coefficient, respectively, are read and memorized in the RAM of the engine control unit (ECU) 9. Subsequently, a decision is made at step S202 as to whether the engine 1 has started. If the answer to the decision is "YES," then a flag F is set to "0." The flag F is set to "0" immediately after engine start-up and it indicates that the canister 31 is its initial condition. On the other hand, once a signal Vo representative of the concentration of oxygen turns from a lean level for lean air-fuel ratios to a rich level for enriched air-fuel ratios and then, it turns again to the lean level from the rich level during the execution of air-fuel feedback control, the flag F is set to "1" to indicate that the canister 31 has gotten off its initial condition at, for instance, step S214 or S216.

Until the canister condition flag F is set to "1" after engine start-up, i.e., until the answer to any one of decisions made at steps S205 through S208 and S210 becomes "NO," the control sequence returns to the main routine and consequently, any learning is not executed. In other words, because, in, for instance, a burning sun or the like, a great deal of evaporation of fuel is possibly caused immediately after engine start-up, it is undesirable to execute learning in such an external condition. When, a change in air-fuel ratio from lean to rich, and thereafter to lean again is detected through steps S205–S210, a decision is made at step S212 as to whether an absolute value δCfb of a change in the feedback correction coefficient Cfb of air-fuel ratio is larger than 10% for a period from a time the air-fuel ratio changed rich to a time it changed lean. The feedback correction coefficient Cfb is detected at step S209 when the air-fuel ratio changes rich and at step S211 when the air-fuel ratio changes lean. If a larger than 10% of change δCfb is detected, this indicates that a great quantity of fuel has evaporated and the canister 31 is filled with evaporated fuel, then, a latest learning correction coefficient ClrIP (i) for idling and purging is set to a specific value toward a larger side, for instance 20% at step S213. Subsequently, after setting the canister condition flag F to "1" and a flag G to "1," the sequence returns. Herein, the flag G set to "1" indicates that an on-idling and on-purging learning is being executed. Setting the latest learning correction coefficient ClrIP (i) to a large number enables a fluctuation of air-fuel control to converge in a short time.

On the other hand, if the change δCfb is less than 10%, then, a preceding learning correction coefficient ClrIP (i-1) is substituted for the latest learning correction coefficient ClrIP (i) at step S215. Subsequently, after setting the canister condition flag F to "1," the sequence returns. That is, when the change of feedback correction coefficient δCfb for air fuel ratio is less than 10%, i.e. when the canister 31 is filled with less evaporated fuel, a preceding learning correction coefficient ClrIP (i-1) is renewed as the latest learning correction coefficient ClrIP (i) and memorized. However, when the canister 31 is filled with trapped fuel and the change of feedback correction coefficient δCfb is larger than 10% in such a case that the vehicle is left in a burning sun for many hours, if the air-fuel ratio is corrected without reducing the concentration of oxygen so as sufficiently to lower the change of feedback correction coefficient δCfb to a certain value, for instance 10%, the difference of air-fuel ratio due to the evaporated fuel is judged to be larger than that value and a certain high value, for instance 20%, is memorized as a learning correction coefficient for idling. As a result, as described above, in such a case that a large change is caused in evaporated fuel quantity in the canister 31 during engine halting, a tentative renewal of learning correction coefficient is made possible, so as to minimize the deterioration of drivability due attributive to over-enriched air-fuel ratios and the deterioration of exhaust emission property.

Subsequent to setting the canister condition flag F to "0" after engine start at step S204, control proceeds to step S217 where a decision is made as to whether the engine 1 is now on-idling. This is because, learning is executed in the range of idling operation in which the engine 1 is stable in rotational speed. The following description is directed to the case of on-idling and on-purging for the sake of convenience.

In such a case, a decision is made at step S219 as to whether the learning flag G has been set to "1." If the answer to the decision is "YES," then, a preceding learning correction coefficient ClrIP (i-1) added by 50% of a mean value [Cfb] of all of preceding feedback correction coefficients Cfb for on-idling learning Crb is substituted for the latest learning correction coefficient ClrIP (i) at step S220. the reason of the addition of 50% of a mean value [Cfb] of all of preceding feedback correction coefficients Cfb is that when the answer to the decision made at step S219 is "YES," this indicates that a great deal of evaporated fuel remains in the canister 31, the mean value [Cfb] is large. Consequently, if substituting this large mean value [Cfb] for the learning correction coefficient ClrIP as it is, a gain in air-fuel ratio feedback control becomes larger in excess, and consequently, there is caused a fear of a divergence of feedback control.

On the other hand, if the answer to the decision made at step S219 is "NO," this indicates that the change of feedback correction coefficient δCfb is less than 10% after the canister 31 has gotten off its initial condition, because it is regarded that the air-fuel ratio feedback control was stable before the change of the canister condition flag F to "1," there is no problem in using a mean value [Cfb] obtained at the change of the canister condition flag F to "1" for a learning correction coefficient ClrIP. Accordingly, at step S221, the mean value [Cfb] is substituted for the latest learning correction coefficient clrIP(i). Then, the learning flag G is set to "1."

The difference between the substitution of a preceding learning coefficient ClrIP (i-1) added by 50% of a mean value [Cfb] at step S220 and the substitution of a mean value [Cfb] at step S221 is described as follows. The substitution of ClrIP (i-1)+[Cfb]/2 is made only once when the learning flag G remains "0" with a change δCfb of less than 10%, i.e. when control proceeds from step S219 to step S221. In other words, since, even if the learning flag G is set to "0," it is set to "1" step S222, ClrIP (i-1)+[Cfb]/2 is used only once. After the substitution of ClrIP (i-1)+[Cfb]/2 for a latest learning correction coefficient ClrIP (i), ClrIP (i-1)+[Cfb]/2 is substituted for a latest learning correction coefficient ClrIP (i) at step S220. When the learning flag G is set to "1" at step S214, the preceding learning correction coefficient ClrIP(i-1) is one learned before engine start-up, i.e. during a last drive of engine.

Figure 9:
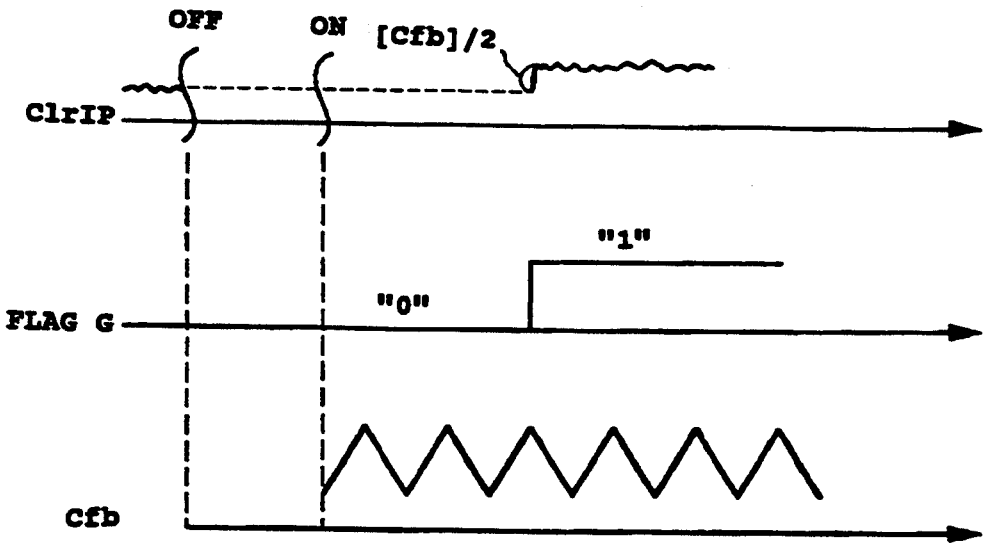
FIG. 9 is a time chart showing the operation of the air-fuel ratio control system when a change of feedback control coefficient is large.
Figure 10:
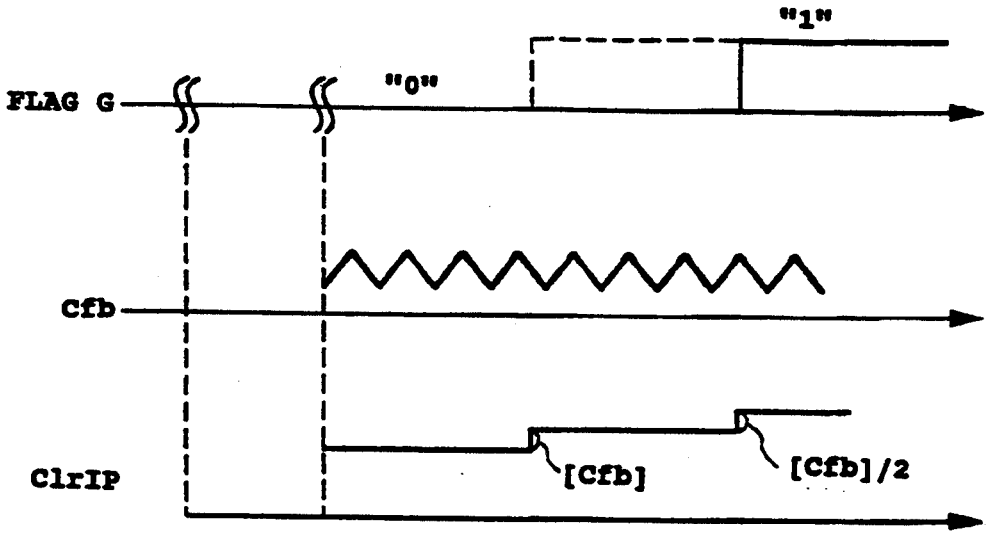
FIG. 10 a time chart showing the operation of the air-fuel ratio control system when a change of feedback control coefficient is small.

Accordingly, as shown in FIG. 9, when the change of feedback correction coefficient δCfb is large before setting the leaning flag G to "1," i.e. when the answer to the decision made at step S212 is "YES," a preceding learning correction coefficient ClrIP(i-1) added by 50% of a mean value [Cfb] (i.e. [Cfb]/2) is substituted for a latest learning correction coefficient ClrIP(i). It is regarded that the preceding learning correction coefficient ClrIP(i-1) reflects the re-evaporated quantity of fuel in the canister 31 at the time, taking the preceding learning correction coefficient ClrIP(i-1) as a starting coefficient possibly accelerates an early convergence of air-fuel feedback control. On the other hand, as shown in FIG. 10, if the change of feedback correction coefficient δCfb is small, i.e. if the answer to the decision made at step S212 is "NO," because no consideration of a preceding learning correction coefficient ClrIP(i-1) is necessary, a mean value [Cfb] of feedback correction coefficients Cfb, which are collected in the period from commencement of learning to the set of the learning flag G to "1," is taken as the starting coefficient of a preceding learning correction coefficient ClrIP(i-1).

When the engine is idling under off-purging, the answer to the decision made at step S218 is "NO," then, a state of a flag H is judged at step S223. Herein, the flag H set to "1" indicates that learning is being executed under on-idling and off-purging. Since the learning flag H has been set to "0" in an initial state, a mean value [Cfb] is substituted for the latest learning correction coefficient ClrIPn (i). Then, the learning flag H is set to "1" at step S225. Once the learning flag H has been set to "1," then, control proceeds from step S223 to step S226 where a preceding learning correction coefficient ClrIPn (i-1) added by 50% of a mean value [Cfb] of all of preceding feedback correction coefficients Cfb for on-idling learning Crb is substituted for the latest learning correction coefficient ClrIPn (i).

Referring to FIG. 8D, subsequent to establishing of a latest learning correction coefficient Clr (i), control proceeds to step S227 in order to establish a succeeding learning correction coefficient Clr (i+1). At step S227, a decision is made as to whether the latest learning correction coefficient ClrIP (i) under on-idling and on-purging is less than 15%. If the answer to the decision is "YES," this indicates that a great deal of lean correction is necessary, then, another decision is made at step S228 as to whether the latest feedback correction coefficient Cfb(i) is larger than 10%, i.e. whether air-fuel ratio feedback control has been performed so as to enrich the air-fuel ratio more than 10%. When the latest learning correction coefficient ClrIP (i) under on-idling and on-purging is sufficiently large to conduct a great deal of leaning correction of air-fuel ratio and the latest feedback correction coefficient Cfb(i) is sufficiently large to conduct a great deal of enriching correction of air-fuel ratio, i.e. the answers to the decisions made at steps S227 and S228 are "YES," the latest learning correction coefficient ClrIP (i) added by 5% is substituted for a succeeding learning correction coefficient ClrIP (i+1). This addition of 5% accelerates the convergence of air-fuel feedback control. Thereafter, a calculation is conducted to obtain the difference of learning correction coefficient δClr (=ClrIP−ClrIPn) during idling between on-purging and off-purging. This learning correction coefficient difference δClr is regarded that it must reflect differences of properties among canisters of engine systems. Based on this consideration, a decision is made at step S231 as to whether the learning correction coefficient difference δClr is larger than zero (0). If the answer to the decision is "YES," then, a deairing coefficient Cda defined according to the purging quantity of air Cpa and the trapping quantity of fuel is decreased by being multiplied by a damping rate K at step S232. After setting a correction execution flag I to set "1," the sequence returns.

This learning correction coefficient difference δClr remains constant as long as the canister 31 is not replaced with another canister. Accordingly, the answer to the decision made at step S231 is always "YES" even after engine start-up. However, if another canister is installed which has the property that a learning correction coefficient difference δClr is less than zero (0), then, steps S234–S236 are carried out. That is, after established a damping rate K of 1 (the damping of deairing coefficient is zero) at step S235 and setting the correction execution flag I to set "1," the sequence returns.

It is also to be understood that although the present invention has been described in detail with respect to a preferred embodiment thereof, various other embodiments and variants may occur to those skilled in the art which fall within the scope and spirit of the invention. Such other embodiments and variants are intended to be covered by the following claims.

What is claimed is:

1. In an air-fuel ratio control system for an internal combustion engine to which evaporated fuel from a canister is supplied and an air-fuel ratio feedback control value is calculated based upon a quantity of evaporated fuel supplied to said engine, an improvement comprising:

a control means for calculating, within a first predetermined range of engine operating conditions, a difference between a first control value calculated during a supplying of said quantity of evaporated fuel to said engine, and another first control value calculated when said quantity of evaporated fuel is not being supplied to said engine, said control means then calculating, within a second predetermined range of engine operating conditions, a second air-fuel ratio control value for controlling said engine, based upon: said first feedback control value used in said first predetermined range of engine operating conditions, a ratio of a quantity of intake air taken into the engine between said first and second ranges of engine operating conditions and a ratio of supplied quantities of said evaporated fuel provided to said engine between said first and second predetermined ranges, said control means then controlling said air-fuel ratio with said second control value operating within said second range.

2. In an air-fuel control system as defined in claim 1, wherein said engine is in an idling condition in said first predetermined range and in a non-idling condition in said second predetermined range.

3. In an air-fuel control system as defined in claim 1, wherein said control means establishes said second control value based further on a ratio of engine rotational speeds between said first and second predetermined ranges.

4. In an air-fuel control system as defined in claim 1, wherein said control means establishes said second control value based further on a value defined according to a purging quantity of air passing through said canister and a trapped quantity of fuel in said canister.

5. In an air-fuel control system as defined in claim 4, wherein said control means varies said value defined according to the purging quantity of air and the trapped quantity of fuel according to a difference in said second control value, during idling, between purging and non-purging conditions.

6. In an air-fuel control system as defined in claim 1, wherein said control means correctively provides a succeeding second control value in said second predetermined range based on at least one of said first control values in said first predetermined range and said second control value in said second predetermined range.

* * * * *